United States Patent [19]

Havriluk

[11] Patent Number: 5,005,140

[45] Date of Patent: Apr. 2, 1991

[54] METHOD AND APPARATUS FOR MONITORING HYDRODYNAMIC THERAPY AND EXERCISE

[75] Inventor: Rod Havriluk, Tallahassee, Fla.

[73] Assignee: Swimming Technology Research, Inc., Tallahassee, Fla.

[21] Appl. No.: 468,618

[22] Filed: Jan. 23, 1990

[51] Int. Cl.[5] ..... A61H 1/02; G06F 15/00

[52] U.S. Cl. ..... 364/550; 272/71; 272/116; 128/774; 128/25 R; 73/379; 364/413.04; 364/571.05

[58] Field of Search ..... 364/550, 558, 571.01, 364/571.02, 571.05, 413.02, 413.04, 413.30, 413.31; 128/25 R, 26, 774, 782; 73/379; 272/71, 96, 116, 122, 129, 130

[56] References Cited

U.S. PATENT DOCUMENTS

| | | | |
|---|---|---|---|
| 4,411,422 | 10/1983 | Solloway | 272/71 X |
| 4,458,896 | 7/1984 | Solloway | 272/116 |
| 4,521,011 | 6/1985 | Solloway | 272/71 X |
| 4,598,381 | 7/1986 | Cucci | 364/571.05 X |
| 4,627,613 | 12/1986 | Solloway | 272/71 X |
| 4,661,920 | 4/1987 | Haze | 364/571.05 |
| 4,685,667 | 8/1987 | McDonald | 272/71 |
| 4,745,930 | 5/1988 | Confer | 128/782 X |
| 4,759,544 | 7/1988 | Diaz | 272/71 X |
| 4,763,275 | 8/1988 | Carlin | 364/550 |
| 4,763,284 | 8/1988 | Carlin | 364/550 |
| 4,774,679 | 9/1988 | Carlin | 364/550 |
| 4,813,668 | 3/1989 | Solloway | 272/71 X |
| 4,819,485 | 4/1989 | Del Giorno et al. | 73/379 |
| 4,819,951 | 4/1989 | Solloway | 272/130 X |
| 4,824,103 | 4/1989 | Smidt | 73/379 X |
| 4,889,108 | 12/1989 | Bond et al. | 128/25 R |
| 4,902,005 | 2/1990 | McNeill | 272/116 |
| 4,913,418 | 4/1990 | Schlueter et al. | 272/116 |

*Primary Examiner*—Joseph L. Dixon

*Attorney, Agent, or Firm*—McGlew & Tuttle

[57] ABSTRACT

A method and device for monitoring and measuring underwater physical therapy or exercise employing hydrodynamic elements or aquatic exercise devices. Measurements are taken via pressure ports formed on first and second opposite surfaces of the hydrodynamic device to provide a pressure differential signal. This pressure differential signal may be compared to a calibrated zero signal to form a measurement signal. The measurement signal is then converted to a digital signal for evaluation by a digital computer. The data corresponds to the exercise performed and may be stored and evaluated. The arrangement provides information with regard to the type of exercise performed and the degree of exercise performed.

4 Claims, 4 Drawing Sheets

METHOD AND APPARATUS FOR MONITORING HYDRODYNAMIC THERAPY AND EXERCISE

FIELD AND BACKGROUND OF THE INVENTION

The present invention relates, in general, to measuring and monitoring schemes and, in particular, to a new and useful method and apparatus for measuring and monitoring the performance of a patient or athlete during hydrodynamic therapy or exercise.

Hydrodynamic therapy and exercise, for patients undergoing physical therapy and athletes undergoing physical therapy has significant advantages over conventional exercise and physical therapy using conventional devices. Conventional devices are often awkward, cumbersome and complex and are not suitable for interchangeable use by men, women, and children having different physical capabilities and strengths, without extensive modification. Additionally, many of the conventional exercise devices exert an excess amount of torque and torsion (twist) on the joints of the user and are therefore not usually suitable for many types of physical therapy and exercise.

Hydrodynamic devices have been proposed for use for physical therapy and exercise in water, thereby controlling more thoroughly the torque, torsion and resistant forces which are exerted on the joints of the patient. Various arrangements for aquatic exercise assemblies have been proposed including the arrangements taught by U.S. Pat. No. 4,311,306; 4,627,613; 4,411,422; 4,416,451; 4,521,011; 4,458,896 and 4,468,023, all of Solloway. Such hydrodynamic exercising arrangements are well-adapted for filling physical therapy needs. Unfortunately, the benefits of therapy within the water are somewhat lessened by problems relating to the inability to closely monitor the degree of exercise provided and the effect of the exercise on the patient. The use of such hydrodynamic arrangements, by repetitions or the like, does not necessarily guarantee that a specific amount of exercise has been completed (does not guarantee a predetermined amount of work has been performed) and that the exercise has been performed in the proper manner.

SUMMARY OF THE INVENTION

The present invention relates to measuring aspects of physical exercise by sensing pressure changes in fluids in enclosed spaces which are in contact with a body part of a person using the arrangement and pressure exerted on surfaces by the person using the invention.

It is an object of the invention to provide a method and system arrangement for closely monitoring the use of a hydrodynamic exercise arrangement such as an aquatic exercise assembly, such that the exercise may be performed in a correct manner with a force distribution which is observable and recordable and repeatable by using data as feedback to the patient.

The invention proposes employing aquatic exercising assemblies or hydrodynamic elements which may be held or attached to a body part of the patient or athlete and used in a pool or the like with a system including sensor elements and monitoring means for the observation and recordation of the exercises. As an aquatic exercise assembly or hydrodynamic device, the invention employs a hydrodynamic resistance element, such as the elements of U.S. Pat. No. 4,311,306; 4,627,613; 4,411,422; 4,416,451; 4,521,011; 4,458,896 and 4,468,023.

U.S. Pat. No. 4,311,306; 4,627,613; 4,411,422; 4,416,451; 4,521,011; 4,458,896 and 4,468,023 are hereby incorporated by reference.

The present invention is drawn to an apparatus and method for measuring and observing the forces acting on surfaces of a hydrodynamic element by sensing a differential in pressure between surface sides of the hydrodynamic element. A calculation is made to determine the area under the curve, which area is directly related to the performance. According to the invention, the data may be presented to provided work, force and various other measurable quantities which are analyzable with respect to aspects of exercise repetitions (such as peak force per repetition) and with the provision of multiple sensors, maps of force distribution on body parts may also be provided.

It is a further object of the invention to provide a hydrodynamic therapy monitoring arrangement which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 2:
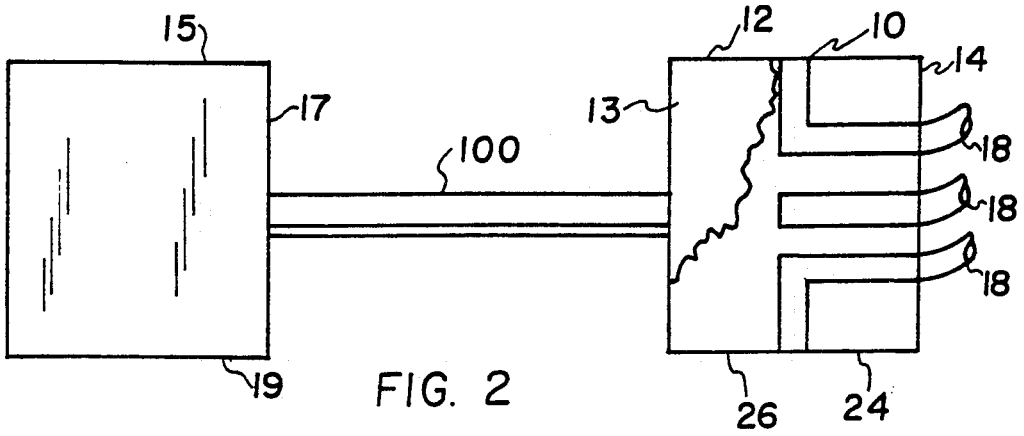
FIG. 2 is cross-sectional view showing an arrangement of pressure elements on an aquatic exercise assembly according to the invention.
Figure 1:
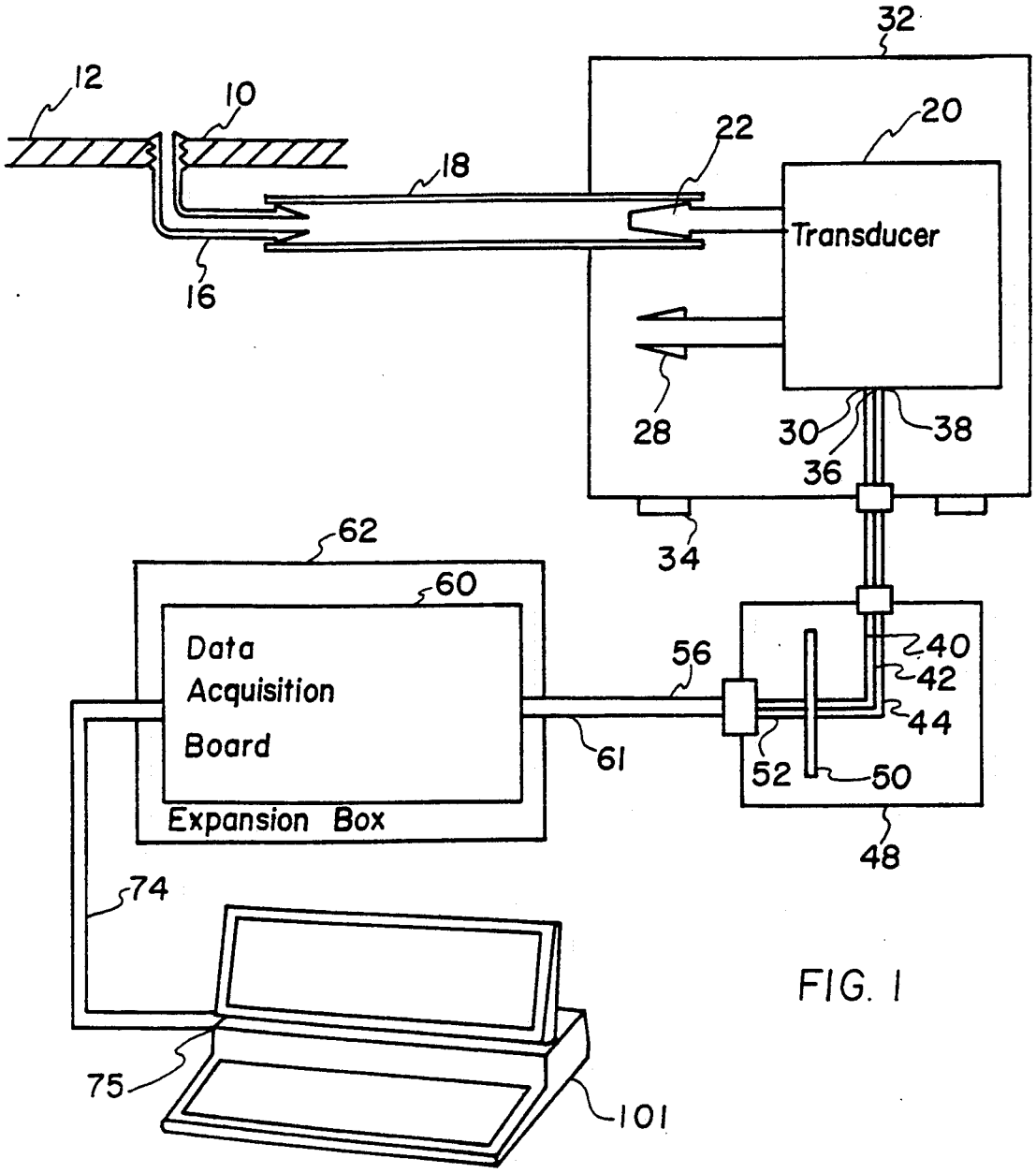
FIG. 1 is a schematic view showing a system and device in accordance with the invention.

Referring to the drawings, in particular, the inventive system preferably includes a remote port 10 provided in a surface 12 of a hydrodynamic element 14. The remote port 10 is exposed to the pressure acting perpendicular to the submerged surface 12. The remote port 10 is connected to a transducer 20 by plastic tubing 18. In this way, pressure is relayed via the plastic elbow joint 16 (such as CRAFTECH part no. 0302-1 or VALUE PLASTICS #KL230-2) and plastic tubing 18 to a connection port 22 of the transducer 20. For attachment to some hydrodynamic devices, a straight plastic conductor 301 (such as CRAFTECH part no. 0300-5 or VALUE PLASTICS #K230-2) may mount the remote port in the most advantageous manner (see FIG. 5).

The transducer 20 (such as MOTOROLA Model MPX-3100 DP) measures fluid pressure in a line or provides a differential pressure signal representing two sensed pressures.

A second remote port 24 is provided on an opposite surface 26 of the hydrodynamic element 14. The second remote port 24 is connected to a second connection port 28 of the transducer 20 by means of an elbow joint and plastic tubing in the same manner as the first remote port 10. The remote ports 10 and 24 are mounted on different sides of a hydrodynamic element, such as element 14, to allow a differential pressure to be measured at the transducer 20.

Depending on the orientation of the transducer, the remote port may not be necessary. In some cases the pressure may be sensed directly at the transducer ports 22 and/or 8 by positioning the transducer ports in or on the hydrodynamic device.

Transducer 20 is advantageously enclosed in a plastic box 32 which can be mounted to a surface by support elements or feet 34.

The transducer 20 includes terminals, such as output 30, ground 36, and voltage 38. These terminals are connected via a cable or wires, respectively 40, 42, 44 to the calibration circuit board 50. The calibration circuit 50 board is preferably positioned within a plastic box 48 (such as POLYCASE 883-0431 with POLYCASE cover 883-0471) or a container of other material which is waterproof or may be waterproofed.

Figure 3:
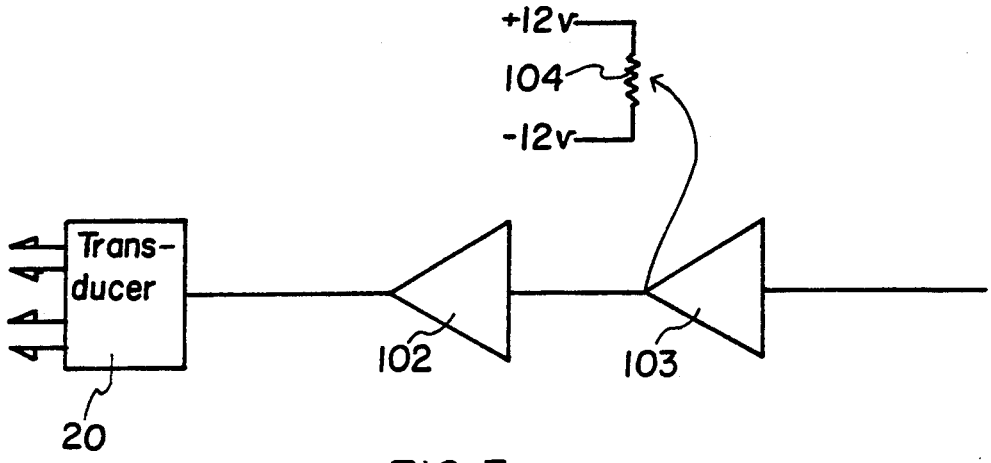
FIG. 3 is a schematic view showing the signal conditioning in the transducer arrangement.
Figure 4:
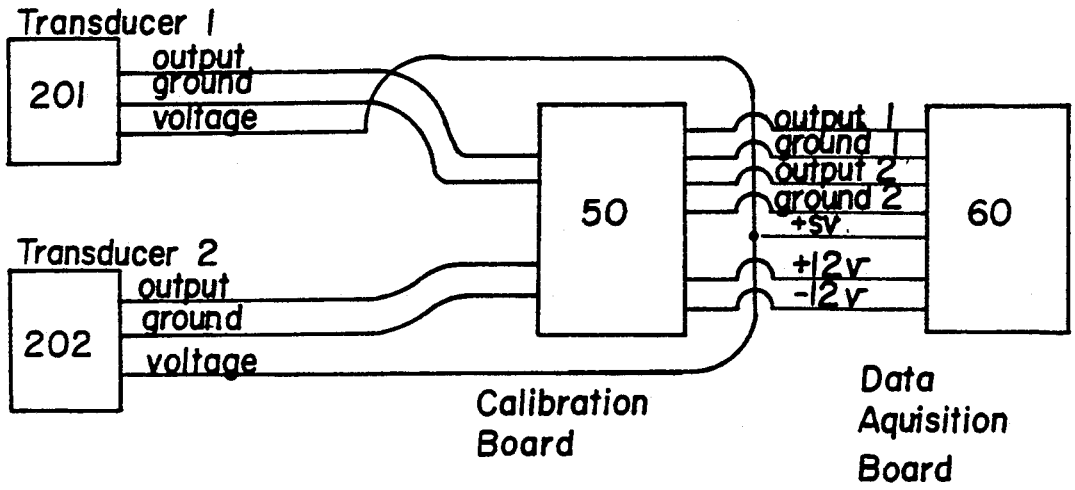
FIG. 4 is a schematic view showing the connection of the transducer to the calibration board and data acquisition board.

Referring to FIGS. 3 and 4 in particular, the output of the transducer 20 is a voltage signal. This voltage signal varies directly with the differential pressure between the positive and negative ports. The calibration circuit 50 allows the base line voltage signal (representing the pressure differential) which is omitted from the transducer, to be adjusted so that the base line signal can be centered on a base line of the computer screen or the like. The adjustment may be made by turning the trimmer 104 which is mounted on the calibration circuit board 50. As shown specifically in FIG. 3, the signal from transducer 20 is first inverted by inverting amplifier 102 (i.e. gain equal negative 1). The output from the inverting amplifier is input into a second amplifier 103. The output from the trimmer 104 is also input into amplifier 103. The output from the trimmer 104 can be adjusted, thereby adding or subtracting voltage to the signal and allowing it to be centered on the desired base line. The output from amp 103 is input into the data acquisition board 60. The actual wiring of the arrangement is best shown in FIG. 4. The calibration circuit board 50 is wired to two transducers 201, 202. The output and ground (common) from each of the two transducers 201, 202 is wired to the board 50. The voltage connection to both transducers is connected directly to the plus 5 volt connection on the data board acquisition board 60. The output of the calibration board 50 consists of an output and ground for each of the transducers connected. The calibration board also has a plus 12 volt and minus 12 volt connection to the data acquisition board to power the circuit. An eight channel arrangement may be provided with eight transducers which are to be wired to four calibration boards (two transducers per board). All the boards are preferably housed in a single enclosure or expansion box with output of the same data acquisition board.

The calibration circuit board 50 is provided with output terminals 52 connected to the output cable 56 which leads out of plastic box 48. The cable 56 is connected to a data acquisition board 60. The data acquisition board 60 (for example, METRABYTE Model DAS 8-PGA) may be mounted and housed in an expansion box 62, (for example, AXONIX, THINPACK Model 1100). The calibration circuit board 50 may also be placed in expansion box 62. The data acquisition board 60 preferably has eight analog channel inputs 61. This arrangement allows eight sensors on different pieces of equipment to be sampled simultaneously, or two sensors on four pieces of equipment, etc. This is extremely useful as it is possible to employ an aquatic exercise assembly with a plurality of surfaces 12, 15, 13, 17, 26, 19, etc. thereby allowing a plurality of exercises using one set-up, i.e. aquatic dumbbell 100 with eight sensors positioned on one aquatic exercise arrangement. Also different surfaces may be monitored to provide additional information to check if the exercise is being performed properly. Additionally, absolute pressure transducers may be used in some configurations. Absolute pressure transducers allow measurement of the water depth when the transducer (or transducer remote port) is mounted on a surface parallel to the direction of movement of the hydrodynamic device.

The expansion box 62 is advantageously connected to a lap top computer 70 preferably secured beneath the lap top computer 70). The lap top computer 70 may be, for example, TOSHIBA MODEL T1100+. The expansion box 62 may simply be connected by a cable 74 to the expansion slot 75 of the computer 70. Of course, a standard desk top type personal computer or the like may also be employed. Additionally, a lap top computer which can receive a data acquisition card, internally, and still have sufficient battery power would be most advantageous. Such arrangements provide even further advantages with regard to the ease of use and mobile aspects of the entire system.

FIG. 2 shows a preferred arrangement employing an aquatic exercise assembly 100 or aquatic dumbbell including hydrodynamic portions 14 with surface 13 and the surfaces not shown. With this arrangement, it is possible to evaluate information with regard to the force acting on one of the perpendicular sets of surfaces. It is also possible to provide additional parts which are redundant ports for an even more accurate measurement or to check for error and to measure twisting motion or differences due to depth.

Several alternative arrangements are possible without departing from the principles of the invention. For example, individual pressure transducers may be mounted on surfaces of the aquatic exercise device and then directly wired to the calibration circuit board 50 or transmitted via a transmitter to a receiver which is connected to the calibration circuit board 50. Such a transducer and transmitting arrangement is disclosed in my U.S. Pat. No. 4,654,010, which is hereby incorporated by reference.

Figure 5:
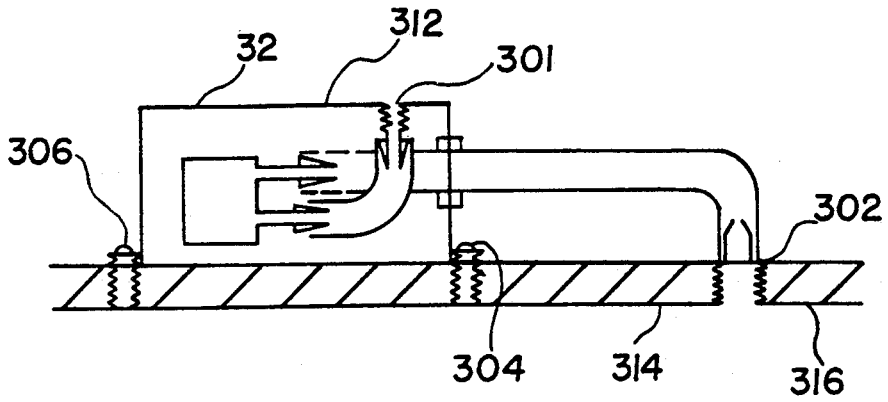
FIG. 5 is a cross sectional view showing an alternative mounting of the transducer arrangement according to the invention.
Figure 6A:
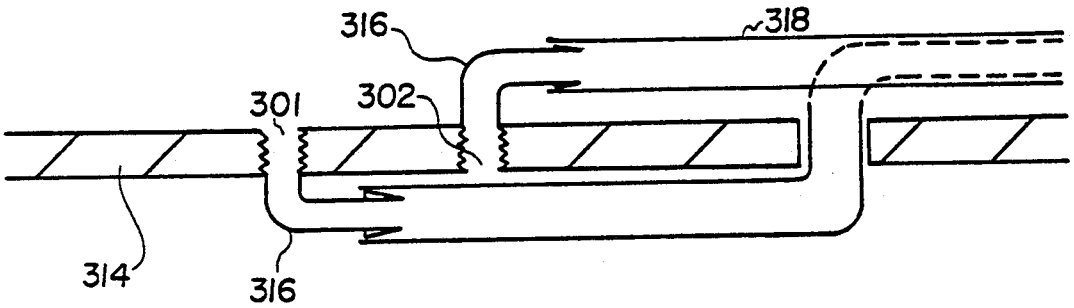
FIG. 6*a* is a view showing a preferred positioning of remote ports on a thin hydrodynamic element.
Figure 6B:
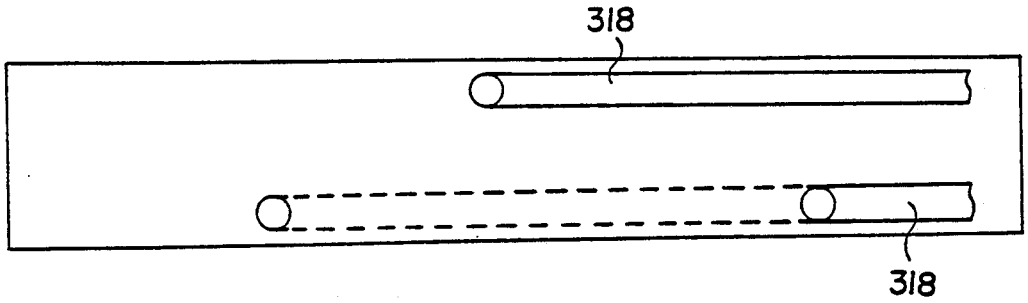
FIG. 6*b* is a top view of the arrangement shown in FIG. 6*a;*

As seen in FIG. 5, and as discussed above, the transducers such as transducer 201 and 202 are available in a size which is small enough to provide the transducers within an enclosure 32 which may be attached to a hydrodynamic surface such as thin hydrodynamic surface 314. The enclosure 32 may be connected by plastic screws or connectors 306 and 304 mounting the feet of the enclosure 32 to the surface 314. As shown in FIG. 5, pressure ports 301 and 302 may be provided in a simple manner with the pressure port 301 being provided in a surface 312, the surface forming part of the enclosure 32. The other port 302 may be provided connected to the surface 316. This arrangement provides an alternative to having the transducers provided a distance from the remote pressure ports. FIG. 6*a* and 6*b* show still another embodiment of the invention in which a relatively thin hydrodynamic surface at 314 is provided with remote ports 301, 302 which are connected to the transducers 201, 202 or the like by a plastic elbow joint connector 316 (such as CRAFTECH part no 0302-1 or VALUE PLASTICS no. KL230-2). These connectors may be connected to plastic tubing or the like 318.

In the arrangement shown in FIGS. 6*a* and 6*b*, the pressure ports 301 and 302 are shown off set, for illustration purposes. It should be understood that the ports may be in alignment one behind the other or several other possible arrangements without parting from the concepts of the invention.

Figure 7:
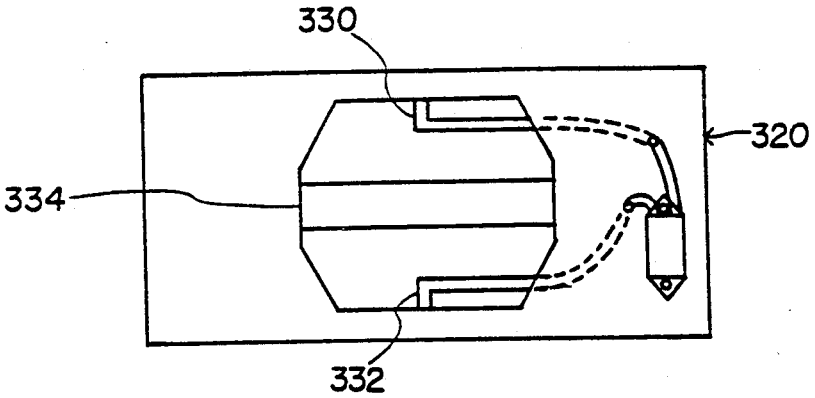
FIG. 7 is a cross sectional view of a barbell aquatic exercise assembly with a pressure transducer mounted thereon; and, FIG. 8 is a cross sectional view of an exercise element with closed containers and remote pressure ports for measuring the pressure in the closed containers using the system of the invention.

FIG. 7 depicts a hydrobell hydrodynamic arrangement 320 with pressure ports 330 and 332 arranged on opposite surfaces. The hand of the user may be clasped around the handgrip 334. The tubing is provided away from the user (as far away as possible such that it does not interfere with the exercise).

The data which is provided to the computer of the system can be evaluated in many ways. The system of the invention may employ software to display a graph or the like of differential pressure versus time. The sampling rate for therapy and exercise purposes is generally about 50 samples per second. However, the system designed in software allows sampling in rates of about 250 samples per second without changes in hardware or any other problems. The pressure may be converted into units of force so that by integration of the curves produced during exercise peak force, average force, impulse and number of repetitions may easily be calculated. If the distance of the movement is also measured by some means other than the sensors of the invention (such as entering distance data into the computer of the system), work, power, and torque can also be calculated.

Software may also be provided for allowing the adjustment of the base line pressure to be handled through the computer. It has been observed that such a software base line adjustment works best for fine adjustment, where as the hardwired hardware adjustment by the calibration board is better for more course adjustment. Software may also provide for channel switching, gain switching and to stop and start data collection. All of these functions may also be controlled by hardware switching. However, such software switching makes the equipment completely controllable at the keyboard and also eliminates the parts necessary for the switch box and the connecting cables. However, in some cases an external on-off switch may be more consistent with typical situations (i.e. the coach could use the external on-off switch as a stop watch which could also start and stop data collection).

The above arrangement may also be used for analyzing and observing swimming technique provided the swimmer is stationary. This is accomplished using water treadmills or swimming flumes or where the swimmer is tethered.

According to a further variant of the system of the invention, the remote pressure ports may be provided connected to closed containers to thereby sense the pressure in the closed containers. This arrangement can be used especially for impact situations such as running, boxing, handball and the like.

Figure 8:
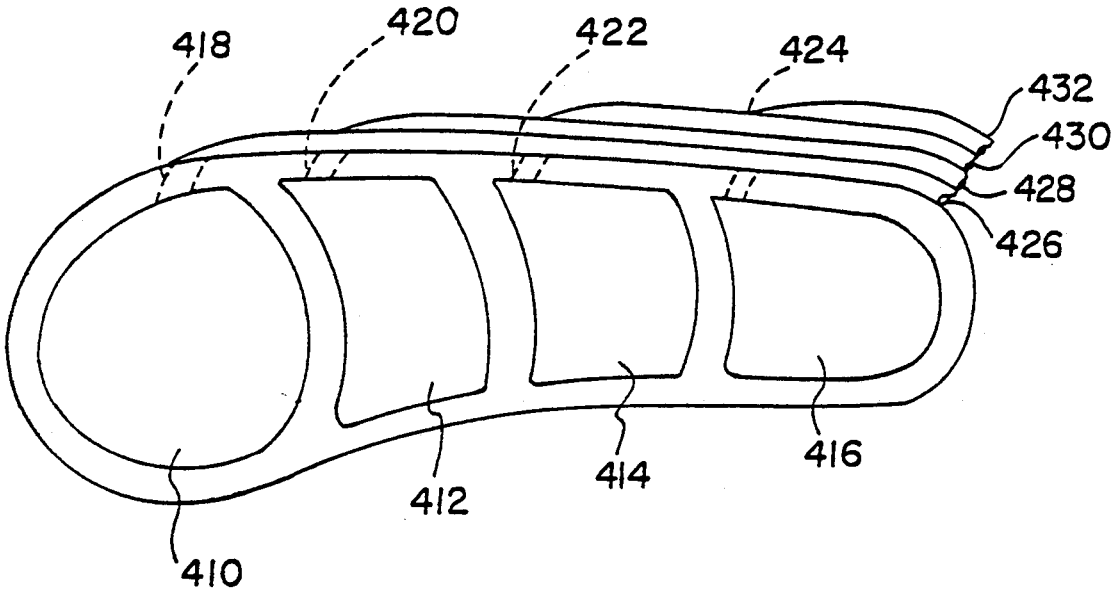

Referring to FIG. 8 in particular, the arrangement according to a further aspect of the invention includes a plurality of closed containers 410 through 416 which are each connected to a pressure port such as remote pressure ports 418 through 424. Each of these remote pressure ports may be connected by tubing to a port of one or more transducers such as transducers 201, 202. The closed containers 110 through 416 preferably are filled with air. According to the arrangement of FIG. 8, the closed containers 410 through 416 are provided in a sole structure of an athletic shoe such as a running shoe or the like. The closed containers are each provided at locations to sense specific information. For example, in the case of running, it may be desirable to provide several closed containers 410 through 416 positioned at important locations such as the ball of the foot (410), the arch of the foot (414) or the heel of the foot (416). More containers and more pressure ports may be provided as desired. According to a preferred arrangement, the pressure ports 418 through 424 are connected to pressure conduit tubes such as 426 through 432, respectively. Tubes may be connected to the transducer at the shoe or the tubes may be run up to a central transducer arrangement such as transducer arrangement 20 which may be strapped to the user or the like.

Other arrangements are also possible using the basic features of the invention. For example, closed container elements may be provided within or on a boxing glove to measure force of an impact or to measure boxing technique. Other sensing arrangements may be provided without departing from the principles of the invention. -

While specific embodiments of the invention have been shown and described in detail to illustrate the application of the principles of the invention, it will be understood that the invention may be embodied otherwise without departing from such principles.

What is claimed is:

1. A system for monitoring and measuring underwater physical therapy, comprising: an aquatic exercise assembly having a first surface and a second surface; a first remote having a first surface and a second surface; a first remote pressure port defined by said first surface; a second remote pressure port defined by said second surface, said second surface being substantially opposite said first surface; a pressure/electrical signal transducer; a pressure conduit connecting each of said first and second remote pressure ports to said pressure transducer, said pressure transducer for sensing the pressure at each of said first and second pressure port via a corresponding said pressure conduit and forming a differential signal representative of the difference between pressure at said first remote pressure port and said second remote pressure port; calibration means for receiving electrical signals from said transducer means and for outputting a zero pressure signal representing a background pressure level; data acquisition means for receiving said differential signal and said zero pressure signal and for outputting a digital signal representative of said differential signal, compared to said zero calibration signal thereby allowing movement of the aquatic exercise assembly to be monitored for monitoring hydrodynamic therapy and exercise.

2. A system according to claim 1, further comprising digital computation means connected to said data acquisition means for plotting a curve of said digital signal over time and for calculating an area under said curve.

3. A method of measuring and monitoring underwater physical therapy using an aquatic exercise device, comprising measuring a pressure differential between a first and second surface of the aquatic exercise device to establish a zero pressure signal; subsequently measuring a pressure differential between first and second surfaces, of the aquatic exercise device during physical therapy or exercise time period; and, calculating an area under the curve as a measurement of the physical therapy performed.

4. An arrangement for monitoring and measuring underwater physical therapy and exercise, comprising: an underwater exercise device with hydrodynamic elements, said hydrodynamic elements defining a first surface and an opposite second surface; a first pressure port formed in said first surface and a second pressure port formed in said second surface; transducer means including surfaces sensing pressure at said first and second pressure ports and generating a signal representative of the difference between said pressure ports; calibration means for determining a base line signal based on a calibration period conditioning said difference signal to output a conditioned difference signal, conditioned by said base line signal; and, computation means including an analog to digital converter for receiving the conditioned differential signal and outputting digital data whereby movement of the underwater exercise device is monitored for monitoring underwater physical therapy and exercise.

* * * * *